United States Patent [19]

Buck et al.

[11] 4,355,806

[45] Oct. 26, 1982

[54] ELECTRONIC JACKS GAME

[75] Inventors: Gordon H. Buck, Torrance; Paul W. Cayley, Jr., Rancho Palos Verdes; Martha K. Hardwick, Costa Mesa; Daniel J. Shoff, Torrance, all of Calif.

[73] Assignee: Mattel, Inc., Hawthorne, Calif.

[21] Appl. No.: 144,799

[22] Filed: Apr. 28, 1980

[51] Int. Cl.[3] ..... A63F 9/00

[52] U.S. Cl. ..... 273/85 G; 273/1 GC; 273/1 E

[58] Field of Search ..... 273/1 GC, 1 GD, 1 GE, 273/1 E, 1 M, 85 G, 118 A, 119 A, 120 A, 121 A, 122 A, 123 A, 124 A, 125 A

[56] References Cited

U.S. PATENT DOCUMENTS

| | | | |
|---|---|---|---|
| 2,460,146 | 1/1949 | Prentice | 273/1 GC |
| 2,636,737 | 4/1953 | Levay | 273/1 GC |
| 4,008,893 | 2/1977 | Yoseloff | 273/85 G |
| 4,017,072 | 4/1977 | Kurtz | 273/1 E |
| 4,021,044 | 5/1978 | Matsumoto | 273/1 E |
| 4,060,242 | 11/1977 | Huang et al. | 273/1 GC |
| 4,082,285 | 4/1978 | Bathurst | 273/237 |
| 4,124,211 | 11/1978 | Worrall | 273/237 |
| 4,162,792 | 7/1979 | Chang et al. | 273/85 G |
| 4,169,592 | 10/1979 | Hall | 273/1 GC |
| 4,296,926 | 10/1981 | Buck et al. | 273/1 GC X |

OTHER PUBLICATIONS

*Complete Book of Games and Stunts*, Hindman ©1956, p. 162, Bonanza Books.

*Primary Examiner*—William H. Grieb
*Attorney, Agent, or Firm*—Ronald M. Goldman; Max E. Shirk; Roy A. Ekstrand

[57] ABSTRACT

An electronic toy game of skill for two players includes an array of illuminatable display elements, such as LED's, randomly selected ones of which are illuminated during each round of play; a corresponding plurality of player switches which are located adjacent to the associated display elements and control means for associating those switches with the lamps in the given manner. During each round of play a continuously perceptible time period is established by the control means. This time period has a duration related to the number of LED's that are to be illuminated during a given round of play. During each player's turn, some LED's are illuminated and by operating the player switches, the player attempts to extinguish the LED's prior to expiration of the time period. Failure to successfully extinguish such LED's results in termination of that player's turn. The winner of the game is that player who first successfully completes a predetermined number of rounds.

10 Claims, 3 Drawing Figures

ELECTRONIC JACKS GAME

BACKGROUND OF THE INVENTION

The present invention relates to hand-held electronic games and, more particularly, to multi-round, multi-player games of skill intended primarily for children.

The advent of low cost miniaturized semiconductor devices, and light emitting diodes, LED's, made practical the design of low cost, battery-operated hand-held electronic games. One example of a hand-held electronic sports game is described in U.S. Pat. No. 4,162,792, entitled "Obstacle Game", which issued in the names of R. S. Chang, et al on July 31, 1979. The latter patent covers a football-like game that is manufactured and sold by Mattel, Inc. under the name "FOOTBALL". That game is played on a playing field defined by 27 light emitting diodes arranged in 3 columns of 9 rows each, the players and player movements being represented by the turn-on and turn-off of adjacent LED's. The football game also contains means to generate sounds, one such sound being a short musical tune that is played upon the occurrence of a "touchdown". Other hand-held sports games manufactured and sold by Mattel, Inc. simulate an automobile race, basketball, soccer and baseball. Those games are now widely known in the toy field.

Not among the above-described games are those that have special appeal to young children, i.e., those based on familiar simple themes. One such game, known as "Red Light-Green Light", forms the subject matter of a U.S. Pat. No. 4,296,926 issued Oct. 27, 1981, which is assigned to the same assignee as the present invention. The game of the present invention is inspired by the children's game known as "Jacks", which is described on page 162 of a book entitled "Complete Book of Games and Stunts", by Darwin A. Hindman, published in 1956.

The mechanical game "Jacks" is not readily realizable in a hand-held electronic format in the inventors' opinion. Hand-held games are limited by size, cost and power consumption considerations to the use of relatively inexpensive and energy-efficient interface devices such as LED's and manual switches. As a result, the designer cannot merely directly simulate game play that calls for physical actions such as bounced balls, hand movements, closed eyes and the like as a practical matter of economics. The challenge of realizing a mechanical game in a hand-held electronic format is increased by the need to provide a game of greater play value than the original mechanical version in order to attract consumer interest.

SUMMARY OF THE INVENTION

In accordance with the invention, there is provided a new and exciting hand-held electronic toy, which is similar to the familiar children's game known as "Jacks", and which has easily mastered but challenging rules of play which is compact and completely portable. The new game represents an improvement over the original game in that it regularizes play by limiting the ability of the players to influence the time available to "pick up" the jacks and in that it provides enhanced play value and excitement as a result of the introduction of features not present in the original game.

The electronic toy comprising the present invention includes in a combination of array of illuminatable display elements, preferably a set of LED's arranged in a circle; a corresponding plurality of player switches located adjacent to associated display elements, a player turn indicator having first and second states in which the turns of respective first and second players are indicated' a round-start/end switch for initiating each round of game play and an on-off/skill select switch. Control circuitry, preferably comprising a programmed microcomputer, is included within the game to control the succession of rounds and turns that make up each game. Generally speaking, the microcomputer contains a ROM and is programmed so that, during each round of play, a player is allowed a predetermined time within which randomly selected ones of the display elements will be illuminated and within which a player can extinguish the illuminated display elements by operating the player switches located adjacent thereto. A player's turn ends when he is unsuccessful in extinguishing all of the randomly selected LED's that become illuminated and reoperating the start/end switch during the time allowed. A game is won by the player who first successfully extinguishes all of the LED's that are illuminated during all of the rounds making up a game.

In addition, to the above-described game play and structure, the present invention comtemplates a number of alternative embodiments. For example, the display elements may be illuminated in sequence or simultaneously during a round: in another, the successful completion of a round results in terminating a player's turn: and still further games are concatenated into a tournament in which each succeeding game is played at a higher skill level.

The foregoing objects and advantages of the invention only briefly summarized above become more apparent from the detailed description of a preferred embodiment which follows considered in annection with the accompanying drawings.

DETAILED DESCRIPTION OF THE PREFERRED EMBODIMENT

Figure 1:
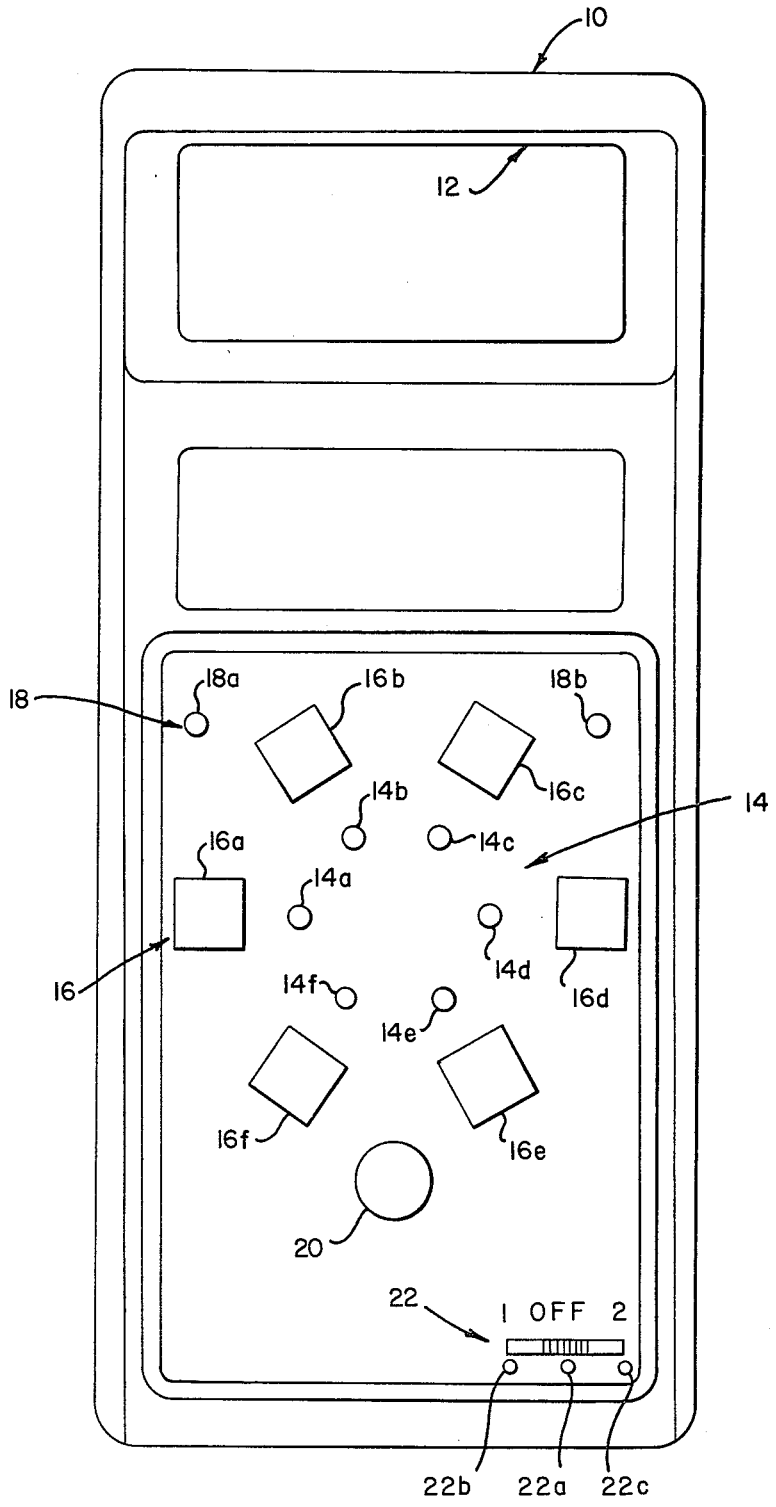
FIG. 1 shows a plan view of the external appearance of one embodiment of the game.

The toy shown in FIG. 1 includes a housing 10, preferably of plastic, containing a carrying handle 12. The housing is illustrated in full scale in two of its dimensions and has a generally uniform thickness of approximately one inch in its third dimension (not shown, which emphasises its small size and portability). The embodiment of FIG. 1 also includes a jacks display 14, preferable comprising an array of six display elements **14*a* through 14*f* arranged in a circular pattern, and a corresponding plurality of six player operated switches 16*a* through 16*f*, preferably comprising momentary contact switches that are located adjacent to respective display elements having the same postcript letter along the circumference of a larger circle. A player turn indicating means 18 in the form of LED's 18*a* and 18*b*, a round-start/end switch 20, sometimes referred to as a "ball button", with which to initiate the play of each round of play and to end each round of play, and an on-off/skill select switch 22 having an off position 22***a* and respective first and second on/skill select positions 22*b* and 22*c*, respectively, are included. Also present though not visible in FIG. 1, is a time period indicator 24, (FIG. 2) preferably comprising an electric acoustic transducer, a speaker. It is understood that the number of display elements in array 14 as well as the number of switches in player switch array 16 may be greater or less than six, but that six has been chosen as a compromise that affords real play value and low manufacturing cost.

Figure 2:
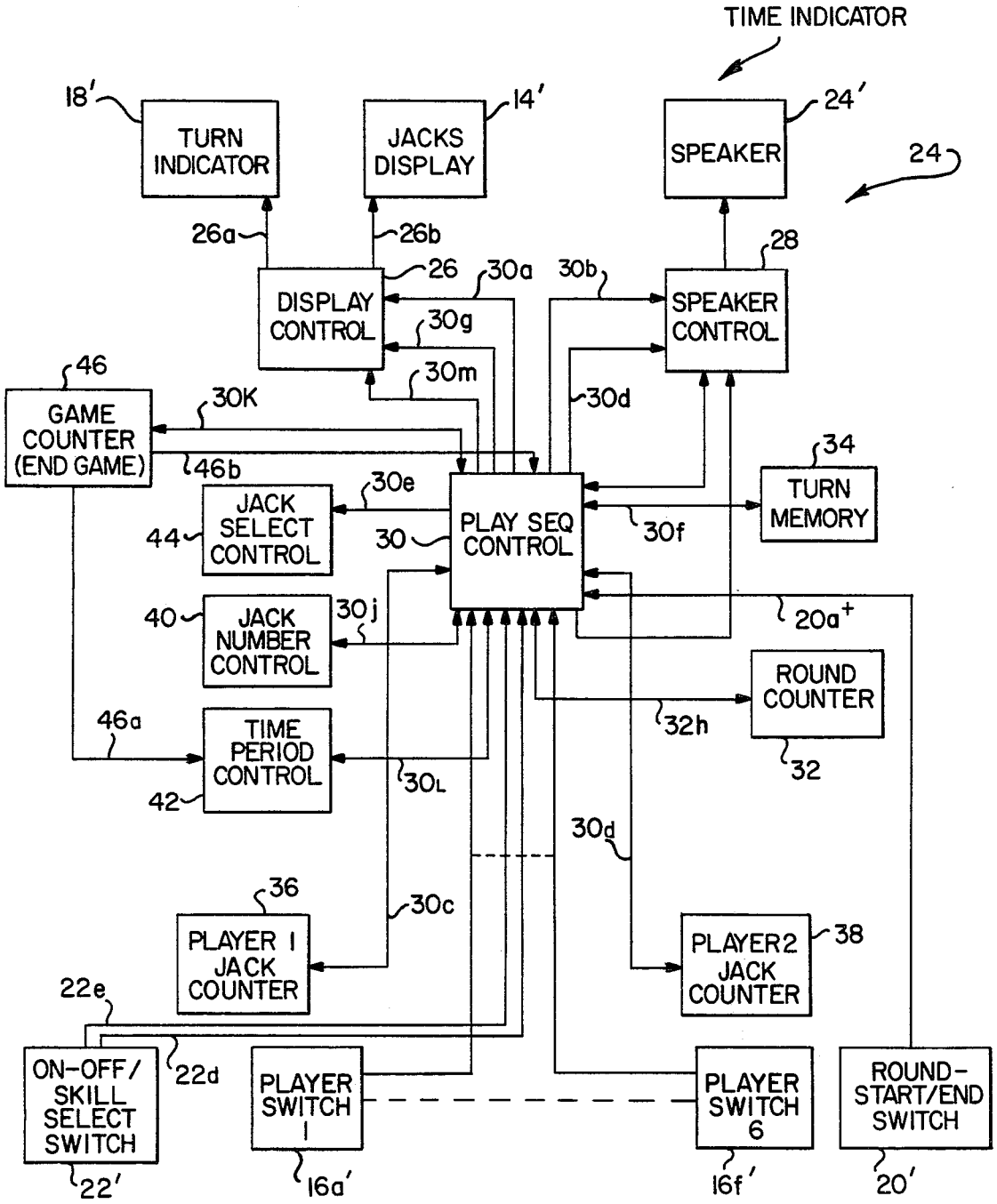
FIG. 2 is a block diagram of one illustrative embodiment of the invention.
Figure 3:
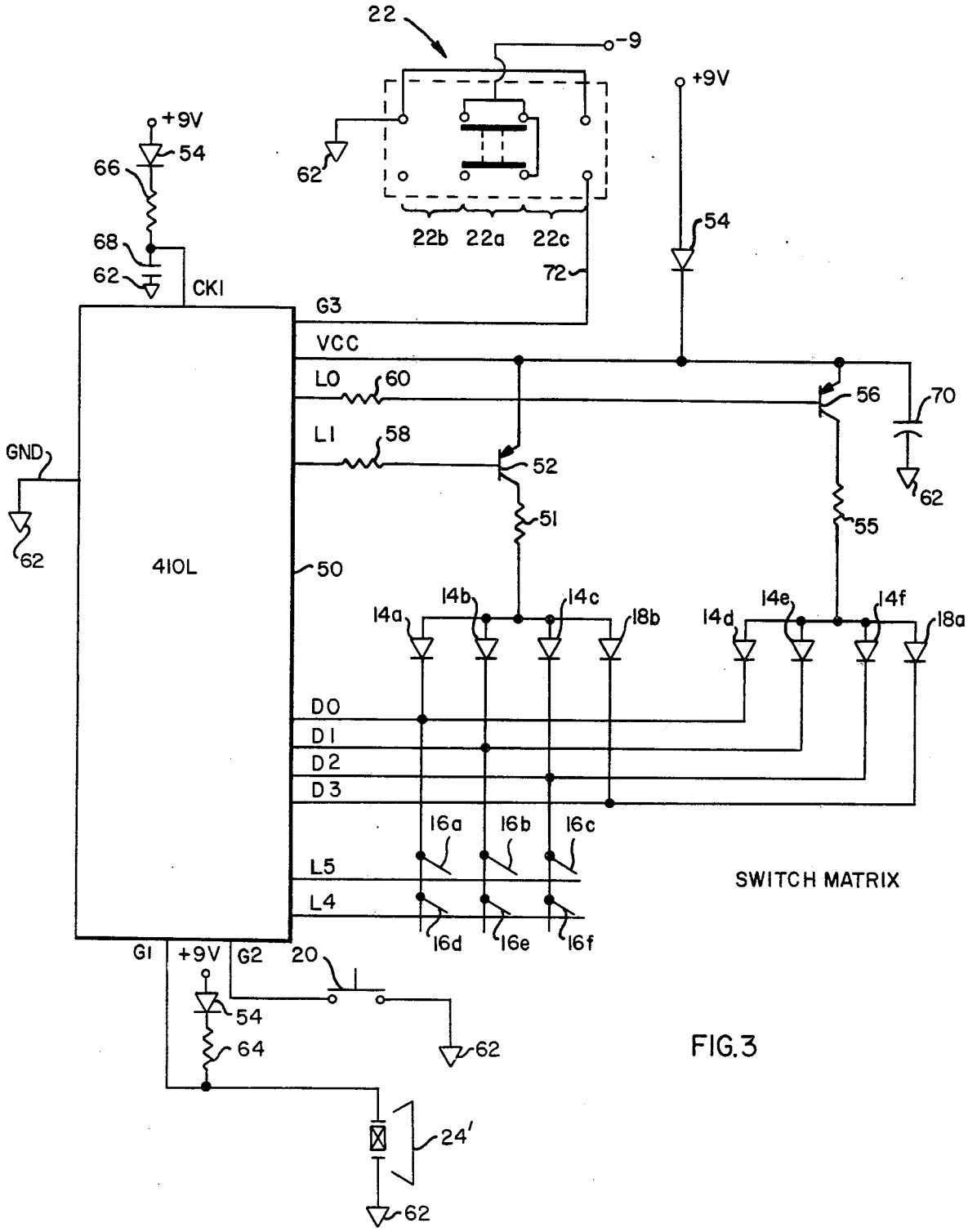
FIG. 3 is a schematic diagram of the internal structure of the preferred embodiment of the present invention.

Included within housing 10 is the electrical control circuitry shown in FIG. 3. A block-diagram representation of that circuitry is shown in FIG. 2. Also located within housing 10 is an electrical printed circuit board for mounting the control circuitry of FIG. 3, including the previously mentioned LED's and switches, speaker 24', and a suitable power source, such as a battery. While the play of the game of the invention is best described primarily with reference to the block-diagram of FIG. 2, the player perceptible manifestations of that play are more easily understood by making reference to FIG. 1, and the electrical manifestations of that play is best understood by reference to FIG. 3. Accordingly, for clarity, those elements that appear in more than one of those drawing figures are assigned the same number.

Generally speaking, the play of the game of the invention is divided into a predetermined number of rounds such as, for example, six. During each round, the player whose turn is indicated by turn indicator 18 is assigned a predetermined time period within which he must successfully "pick up" a number of randomly selected "jacks". The "jacks" that are to be picked up are represented by the illuminated one or ones of the LED's 14*a* through 14*f*, and the "pick up" of each jack is accomplished by depressing the switch adjacent to that jack within the assigned time period. The failure of a player to successfully pick up all of the jacks that are presented during the predetermined time period and to operate the "ball-button" within that same time results in terminating that player's turn and the enablement of the next player's turn. If round start/end switch 20 is depressed before all of the jacks have been picked up, then the round and turn for the current player ends and the next player is indicated. The winner of the game is that player who first successfully picks up all of the jacks that are presented during each of the rounds that make up a game. A number of variations within the scope of this basic game play are possible; such variations will be discussed more fully following the discussion of the basic game play in connection with FIG. 2.

Referring to FIG. 2, there is shown a block-diagram of the preferred embodiment of the invention. In FIG. 2 each block represents a device or set of devices that performs one of the game play functions such as storing the number of the current round or the number of jacks. In addition, each connecting line represents a control relationship between the connected blocks, the directions of the arrows indicating the directions in which control is exerted. It will be understood that if the game is constructed with a programmed microcomputer as is preferred, rather than with hardwired special purpose dedicated logic devices, certain of the blocks in FIG. 2 will represent an instruction or set of instructions, rather than a separate physical device or set of devices as is understood by those skilled in the art. The remaining blocks, i.e., those that represent I/O or interface functions such as manual input switches, represent physical devices in both hardwired and microcomputer-based embodiments of the invention.

The blocks representing the input devices by which the game of FIG. 2 is controlled by the players include player switch blocks 16*a'* through 16*f'*, round-start/end switch block 20' and on-off/skill select switch block 22'. Similarly, the blocks representing the output devices by which the game of FIG. 2 presents game status information to the players include turn indicator block 18', jacks display block 14', and a time period indicator block or speaker 24'. In embodiments (such as the preferred embodiment) in which time period indicator 24 indicates the running of the time period by way of an audio signal rather than by way of a visual (e.g. LED) signal, block 24' can also serve to generate any desired game play sounds such as a victory tune at the end of a game. There is, however, no necessary connection between these two functions. For each block shown in FIG. 2, the prime notation indicates that a corresponding device with the same number appears in FIG. 1, or FIG. 3 or both.

Associated with display blocks 14' and 18' is a display control block 26 which controls the illumination of the individual display elements and thereby causes the displays to show the game status as well as any desired beginning-game, end-game, light presentations depending upon the control information supplied thereto by the remaining blocks of FIG. 2. Similarly, associated with speaker 24' is a speaker control block 28 which controls the generation of game sounds as well as any beginning-game or end-game sound presentations, depending upon the control information supplied thereto by the remaining blocks of FIG. 2.

Included among the other game control blocks shown in FIG. 2 are: a play sequence control block 30 for sequencing the operations of the blocks of FIG. 2 in accordance with the rules of the game; a round counter or round memory block 32 by means of which sequence control 30 updates and monitors the number of rounds successfully completed by each player; a turn counter or turn memory block 34 by means of which sequence control 30 updates and monitors the turns of the players; first and second jack counter or jack memory blocks 36 and 38, respectively, by means of which sequence control 30 updates and monitors the number of jacks picked up by the players during each round; a jack number control block 40 by means of which sequence control 30 determines the number of jacks that are to be picked up during a particular round; a time period control block 42 by means of which sequence control 30 determines the time period during which a player must pick up the jacks presented during a particular round; a jack select control block 44 for selecting, in a generally random manner, which LED's of display 14' will be illuminated during a particular round; and a game counter or game memory block 46 by means of which sequence control 30 updates and monitors the number of games, a feature used in tournament play to keep track of the number of games which have been played.

As the game is turned on by the movement of switch 22' from its off position 22*a* to one of its on-skill select positions 22*b* or 22*c*, sequence control 30 is initialized through line 22*d* to begin preparations for a game of six rounds, or is initialized through line 22*e* to begin preparations for a game of twelve rounds. Sequence control 30, in turn, initializes the remaining blocks of FIG. 2 to establish conditions appropriate to the first round of play and to initiate the desired beginning-game light presentation through line 30*a* and the desired beginning-game sound presentation through line 30*b*.

The initialization of the preferred embodiment of the game may be summarized as follows: sequence control 30 initializes jack counters 36 and 38 to zero, through lines 30*c* and 30*d*, respectively, stores information that neither player has operated any switches, i.e., has not picked up any jacks; jack select control 44 is enabled by control 30, through line 30*e*, to prepare it to present jacks via illumination of selected LED's to the player who is to have the first turn; player turn memory 34 is initialized by control 30, through line 30*f*, to give player number one the first turn, a condition which control 30 then signals to the players by turning on turn indicator LED 18*a*, through line 30*g*, display control 26, and line 26*a*; round counter 32 is initialized by control 30, through conductor 32*h*, to store the fact that both players are in the first round of play; jack number control block 40 is enabled by control 30 through line 30*j*, to place it in a condition in which control 30 may refer to it for the number of jacks that are to be picked up during the first round; game counter 46 is initialized to 1 by control 30, through line 30*k*, to reflect the presence of the first game; time period control block 42 is enabled by game counter 46, through line 46*a*, to place it in a condition in which control 30 may refer to it, through line 30L for the time period to be used for the first round of the first game. Once the foregoing conditions are established, sequence control 30 has available to it all of the information in electronic form necessary for the beginning of play. This initialized or ready condition will continue until a player pushes round-start/end switch 20' and thereby supplies a start signal to sequence control 30, through line 20*a*.

Depending upon the manner in which start/end switch 20' is depressed or released, game play begins in one of two ways. If start/end switch 20' is depressed and held down, sequence control 30 displays to the players the number of jacks that are to be picked up during the current round and actual game play begins when start/end switch 20' is released. In the preferred embodiment, this is accomplished as control 30 causes speaker control 28 to provide the audible indication (one at a time) of the number of jacks then called for by jack number control 40, which in the present example is one. Thereafter, upon release of start/end switch 20', control 30 energizes speaker control 28 to generate a sound having a duration equal to the time within which the jacks presented during that round must be picked up, i.e., the time called for by time period control 42. In order to enhance the play value of the game, the sound produced by speaker control 28 and speaker 24' need not be a continuous simple tone but may, instead, comprise a tone having increases in pitch between first and second values during one half of the time period and which decreases in pitch between those same two values during the second half of the time period. In this way, there is simulated in the medium of sound the upward movement, stoppage and fall to earth of a ball in the original game of jacks. In addition to the resulting entertainment value, the shifting frequency of this tone also serves to provide to the players a continuous indication of the time remaining within a round. It will be understood that if the time period indication is provided to the players by means of a visual rather than an audible signal, the corresponding result may be achieved by causing a set of time indicating LED's or time indicating digit to make an appropriate elapsed time indication.

If a player releases start/end switch 20' immediately after depressing the same, the above described delay in the beginning of the time period indication will not occur. Instead, control 30 causes the above-described indication of the number of jacks to be picked up during the current round and immediately thereafter begin the above-described time period indication.

As the time period indicating tone is first produced by speaker 24', control 30 interrogates jack select control block 44 through line 30*e* to request and receive back the identity of a randomly selected LED for pick up by the then playing player. This randomly selected display element will then be indicated to the players by display control 26 which receives commands from control 30 through conductor 30*m* and which operates the jacks display 14' through line 26*b*. Control 30 then waits for the receipt of a signal from the player switch corresponding to the then selected jack and, if that signal is received during the time period, extinguishes the illuminated "jack" and updates (increment) jack counter 36 through line 30*c*. Control 30 then waits for the receipt of a signal from the start/end switch 20', and if that signal is received during the time period, concludes the sequence of events that comprise the pickup of a single jack. Since, in the present embodiment, the number of jacks to be picked up during a round, as indicated by jack number control 40, is equal to the number of the round then being played, as indicated by round counter 32, and equal to the contents of the first player's jack counter 36, the pick up of this jack during the first round results in the successful completion of that round.

In the present embodiment, the successful completion of the first round does not result in the termination of the first player's turn. Instead, sequence control 30 interprets the successful completion of the first round as the signal to initialize itself for the beginning of the second round of the first player. This is accomplished in the manner previously described as sequence control 30 initializes player 1 jack counter 36 to 0, increments the round counter for the first player to 2 and refers to jack number control 40 and time period control 42 for the number of jacks and time period associated with the second round of play. Once this round initialization is completed, the game of FIG. 2 is ready to begin the next round of play. This condition persists until the player whose turn it is again operates start/end switch 20' to indicate the number of jacks to be picked up during his next round of play and initiates the time period indication.

During the second round, play proceeds in the manner described in connection with the first round except that in the second round two, rather than one, randomly selected jacks are presented and a time period approximately twice as long as that associated with one jack is made available. As the play of the second round is initiated by the operation of start/end switch 20', sequence control 30 causes time period indicator 24 to begin producing the above described tone and, in accordance with the random jack selection made by jack select control 44, causes a first randomly selected jack to appear on jacks display 14'. If the player depresses the player switch adjacent to the illuminated jack during the time period, that jack is turned off (picked up) and jack counter 36 is updated accordingly. Thereafter, a second randomly selected jack is illuminated. If this jack is also picked up with the time period, jack counter 36 is again updated and if the start/end switch 20′ is also subsequently operated within the time period, the second round is successfully completed, and round counter 32 is updated accordingly. If this jack is not picked up or switch 20′ is not operated within the time period, however, neither jack counter 36 nor round counter 32 is incremented; the turn of the then playing player is ended and the state of player turn memory 34 and turn indicator 18′ is thereby changed. In either case, sequence control 30 makes the initializations in the state of the circuit appropriate to the end of a round and the beginning of the following round, and awaits the next operation of start/end switch 20′.

The above-described play action continues during succeeding rounds with increasing number of jacks being presented during even longer time periods until one of the players is successful in picking up all of the jacks presented during each of the rounds that make up a game. In the preferred embodiment at a first skill level, selected by placing switch 22 in skill select position 22*b*, the number of rounds making up a game is six. At a second skill level, selected by placing switch 22 in second skill selected position 22*c*, the number of rounds making up a game is twelve. It will be understood, however, that both the number of rounds making up a game and the number of skill levels are a matter of choice. Whichever skill level is in effect, upon the successful completion of a game, sequence control 30 initiates a visable display by flashing lights on jacks display 14′ accomplished by issuing the appropriate command to display control 26, through line 30*m*, and initiates the playing of a "victory" tune by issuing an appropriate command to speaker control 28 through line 30*d*. In addition, if the game is one which includes a game counter 46, control 30 updates the same to reflect the completion of one game.

In the event that it is desired that play not terminate at the end of a game, but rather continue through a series of games (or tournament) of increasing difficulty, the end-of-game condition is also used by control 30 via lead 46*b* as the occasion to initialize round counter 32, turn memory 34 and jack counters 36 and 38 to the conditions that should exist at the first round of a new game. Time period control 42 is also conditioned by game counter 46, through line 46*a*, and by control 30, through line 30L, to prepare it to supply to control 30 the shorter time periods that will be used during respective rounds of the new game. Since these time periods require the players to pick up the jacks more quickly, the second game will be seen to be more difficult than the first. This difficulty progression will also apply to the third game with respect to the second and so on through the last game of the tournament, thereby increasing the excitement and play value.

In the present embodiment, the number of games making up a tournament has been chosen to be equal to five but could, in principle, be equal to any other number. It will be understood that at the end of a tournament the game counter will be returned to its initial condition, thereby returning the game as a whole to the condition which existed at the beginning of the first game in a tournament.

In addition to the above-described basic play of the preferred embodiment, the present invention contemplates a number of variations which may be used either instead of or in addition to that basic play. One of these variations relates to whether a player's turn ends with a successful completion of a round. Instead of the previously described game play, for example, the sequence control 30 may be arranged so that a player's turn ends at the end of each round, without regard to whether the player was successful in picking up all of the jacks presented during that round. While this variation represents a departure from the original jacks game, it is desirable in that it reduces the advantage provided to a skillful player who might, by obtaining the first turn, successfully complete an entire game without the other player having a turn. In addition, in the event that the ability of the game to operate in either of these two modes is desired, a turn-mode control switch, by means of which the players may change the rules governing the end of turns, may be added to FIG. 1.

Another variation on the above-described basic game play involves the manner in which jacks are presented to a player during a round. Instead, for example, of presenting randomly selected jacks to the player one jack at a time, in sequence, the game may present randomly selected group of jacks, up to and including all of the jacks to be presented during a round, at the same time. In round four, for instance, the four jacks to be presented could be presented as two successive sets of two randomly selected jacks or as a single set of four randomly selected jacks. In addition, this variation may be made player-selectable by means of an additional control switch, or by means of the operation of prearranged combinations of the switches already present such as, for example, by the holding down of player switch 16*a* during the depression of start/end switch 20.

Still another variation in the basic play may be provided by penalizing a player for the unsuccessful completion of a round by reducing, by one or more rounds, the number of rounds stored for that player in round counter 32. The failure to successfully complete round five, for example, might result in the player beginning his next turn at round three or even round one. As in the case of the previously described variations, this feature may be included in the basic game play or may be made player selectable.

Finally, the time period that is made available during a round may be made a non-linear function of the number of jacks presented during that round. Instead of the time period available to pick up five jacks being approximately five times as long as the time period available to pick up one jack, for example, the time period available to pick up five jacks might be made only three or four times as long as the time period available to pick up one jack. This variation in the length of the time periods should not be confused with the changes in the length of these time periods that are associated with the previously described activity of game counter 46 in progressively increasing the difficulty of each successive game in a series of games. This is because time period called for by time period control 42 may be made dependent both upon the number of jacks to be presented during a round and upon the number of the game in a sequence of games as indicated by game counter 46.

As those skilled in the art recognize, the circuitry used to implement the above-described game may be constructed from a variety of different types of available electronic devices marketed by numerous different semiconductor manufacturers. Among those types of known devices are: general purpose electronic building blocks, such as discrete transistors, AND gates and shift registers; special purpose electronic building blocks, such as custom large scale integrated (custom LSI) circuits that incorporate, on a single chip, in a fixed relationship, large numbers of the just mentioned general purpose electronic building blocks; and general/special purpose electronic building blocks such as microcomputers, which are general purpose LSI devices that may be converted to special purpose devices by the mask programming of a read only memory chip or of the ROM portion of the microcomputer chip itself. The choice as to which of these devices and approaches will be used in a particular design is often related to the number of units to be manufactured. While any of the above-described devices and approaches may be used in physically implementing the present game as schematically illustrated, the preferred embodiment uses a microcomputer that is mask programmable by the manufacturer and in which the program is fixed in tangible form in the ROM portion of the chip in order to take advantage of the small size, low power consumption and low cost of that form of implementation.

As shown in FIG. 3, the preferred embodiment of the invention includes a commercially available, National Semiconductor Corporation microcomputer chip sold under the designation COP 410L. The latter chip is one in a series of chips in the COPS family, COP being an acronym for Control Oriented Processor. The COPS family, including the COP 410L, is described in the publication "National Semiconductor Corporation Manual Number 420305785-001", entitled "COPS Chip Users Manual".

Generally speaking, the chip includes a four-bit arithmetic-logic unit (ALU), a four-bit accummulator, a random access memory (RAM) capable of storing 32 words of four-bits each, a program memory comprising a read only memory (ROM) having a capacity of 512 words of eight bits each, a nine-bit program counter with which is associated a nine-bit, two-level stack, and an on-chip clock. These structures work together to read the input status and data appearing at the chip's input and output (I/0) ports, process that information in accordance with the program stored in the program memory and output the results through the chip's output ports. Thus, the COP 410L chip is typical of many currently available microcomputer chips.

The COP 410L chip is provided with power supply leads VCC and GND, suitable clock control leads like the one shown at CKI, a RESET lead (not shown) through which the program counter and various other registers may be reset, a four-bit output port comprising leads DO through D3, a four-bit I/O port comprising four leads, three of which are shown at G1 through G3, serial input and output leads (not shown) and an eight-bit I/O port comprising eight leads, four of which are shown at L0, L1, L4 and L5. In the description of the schematic diagram which follows, the combinations of numbers and letters which are used by the manufacturer and which have just been introduced will, for the convenience of the reader, be used in the description. It will be understood that those leads which are not shown in FIG. 3 are present, but are not used in implementing the circuit of the invention.

In the schematic diagram of the circuit shown in FIG. 3, all elements that are shown in more than one figure are assigned the same number in all figures. This circuit includes a microcomputer chip 50 which may be of the previously described National Semiconductor type COP 410L. The circuit of FIG. 3 also includes a plurality of LED's 14*a* through 14*c* and 18*b*—the cathodes of which are connected to chip leads D0 through D3, respectively, and the anodes of which are connected to the positive side +9 V of a 9 volt battery through a current-limiting resistor 51, a PNP transistor 52 and a reverse-battery-protection diode 54. Similarly, FIG. 3 includes LED's 14*d* through 14*f* and 18*a*—the cathodes of which are connected to chip leads D0 through D3, respectively, and the anodes of which are connected to the positive side +9 V of the 9 volt supply through a current-limiting resistor 55, a PNP transistor 56 and the previously referenced diode 54. The bases of transistors 52 and 56 are connected to chip leads L1 and L0, respectively, through current limiting resistors 58 and 60, respectively. Also shown in FIG. 3 is speaker 24' which is connected between a circuit ground 62 and the positive supply +9 V, through a pull-up resistor 64 and diode 54, and which is also connected to chip output G1. A suitable RC network comprising a resistor 66 and a capacitor 68 is connected to chip input CKI to set the operating frequency of the on-chip clock. Except for a filter capacitor 70, the remaining devices shown in the circuit of FIG. 3 are manual switches, the functions of which have already been described in connection with FIGS. 1 and 2, FIG. 3 serving merely to show how these devices are physically connected to chip 50 to achieve the previously described results.

The operation of the circuit of FIG. 3 will now be described. When switch 22 is in its center or off position 22*a*, chip 50 is disconnected from the negative supply −9 V of the 9 volt battery and is inactive. In both of the off-center positions 22*b* and 22*c* of switch 22, the negative supply −9 V is connected to chip lead GND, and the circuit of FIG. 3 becomes operative to provide the previously described game play.

When switch 22 is in its leftmost position 22*b*, conductor 72 is disconnected, causing a high-state voltage to appear at chip lead G3. As this condition is sensed during the execution of the program, the flow of the program is altered (as by the setting of flags) to establish operation at the previously described first skill level. When, on the other hand, switch 22 is in its rightmost position 22*c*, ground is applied to chip lead G3 through a conductor 72. As this condition is sensed during the execution of the program, the flow of the program is altered to establish operation at the previously described second skill level. Thus, chip 50 reads the voltage state at lead G3 and uses the same to control the skill level of the game.

Similarly, the voltage states at chip leads G2, L4 and L5 are read by chip 50 to determine whether the flow of the program should be changed to reflect other changes in playing conditions, such as the depression of player switches 16*a* through 16*f* or start switch 20. Chip lead G1, although conceptually a part of a four-bit I/O port including lead G2 is used as a one-bit output to speaker 24'. This usage of lead G1 as an output is possible because chip 50 is programmed so that the state of lead G1 is not used during the execution of input instructions and so that the state of lead G2 is not used during the execution of output instructions.

Once the normal playing condition of the game has been established, the illumination of LED's 14*a* through 14*f* and 18*a* and 18*b* and the sounds generated by speaker 24' are determined by the sequence of voltage states which chip 50 produces at leads L0 and L1, D0 through D3, and G1 thereof. All of the latter are, in turn, controlled in accordance with the flow of the game program, as determined by the conditions which switches 16*a* through 16*f* establish at chip leads L4 and L5 and the conditions which switch 20 establishes at chip lead G2.

In spite of the fact that the cathodes of at least two LED's are connected to each of the "D" outputs of chip 50, and in spite of the fact that the anodes of four LED's are connected in parallel and controlled by a single one of chip leads L0 and L1, each of the LED's can be illuminated only as a result of the coincidence of energizing conditions at one of the "L" outputs and one of the "D" outputs, LED 14*a*, for example, is illuminated only when a low-state voltage at chip L1 turns on LED driver transistor 52 at the same time that a low-state voltage appears at chip output lead D0. Similarly, LED's 14*b* through 14*f* and 18*a* and 18*b* are illuminated only during the coincidence of other combinations of voltages at chip leads L0 and L1 and D0 through D3.

The turn-off of LED's 14*a* through 14*f* is also controlled in accordance with the coincidence of conditions at different chip leads. The illumination of LED 14*a* as a result of the coincidence of low-state voltages at chip leads L1 and D0, for example, is terminated as the closure of switch 16*a* causes the voltage at the cathode of LED 14*a* to be applied to chip lead L5. It will be understood that player switches 16*b* through 16*f* function in a similar manner to extinguish LED's 14*b* through 14*f*, respectively, response to similar coincidence conditions at the "D" and "L" chip leads of chip 50. The presence of this voltage at lead L5 is subsequently sensed and interpreted by the program as being the approximate condition to effect the extinguishing of LED 14*a* by removing one or both of the energizing conditions at output D0 and/or L1.

In producing the previously described game sounds, speaker 24' conducts current through current limiting resistor 64, except when the speaker side of resistor 64 is grounded by a low-state voltage at chip lead G1. As a result, when the execution of the program causes chip lead G1 to alternate between its high and low voltage states, an intermittent current will flow through speaker 24'. This intermittent current is converted by speaker 24' to audible sounds. The timing information necessary to cause these audible sounds to conform to the desired game sounds is stored in a program of chip 50 in any conventional manner and is used as necessary during the execution of the program. Because the internal layout and operation of the chip used in the preferred embodiment (an equaivalent computer or processor chips) are well-known to those skilled in the art, the structure and operation thereof will not be further described herein.

Given the above-described circuit elements and the above-described rules of play, those programmers having skill in the programming arts are able, without undue experimentation, to prepare the kinds of programs which can be used in implementing the preferred embodiment and it is believed unnecessary to include the details of any particular program listing in this specification. By way of specific example of an object code program listing used in the construction of the preferred embodiment of the invention, one may make reference to the object code program listing copyrighted by Mattel, Assignee of this application, which accompanies this application and which is expressly incorporated herein by reference. If the hexadecimal numbers comprising the accompanying program listing are loaded (as by well-known mask programming techniques) into the hexadecimally designated addresses of the program memory of the subject COP 410L chip, the resulting chip will operate in the manner described above to provide the game play of the preferred embodiment of the invention. It will be understood that there are many possible program capable of providing the desired game play. Similarly, other technical details useful in production of games, such as the manner of fabricating suitable plastic housings, the circuit board switch covers, and other constructional details are of infinite variety and are generally known to those skilled in the art and are not necessary to an understanding of the invention and are thus not further described.

Although the invention has been described with reference to a particular microcomputer chip and a particular program, it should be appreciated that the scope of the present invention should be determined solely with reference to the following claims:

What is claimed is:

1. A multi-round hand-held electronic game for simulation of Jacks game play by two players comprising:

a set of illuminatable display elements;

a player turn indicator having first and second states;

a plurality of player switches, each player switch being located adjacent to a respective one of said display elements of said set;

control means for imposing upon game play the rules of the game of Jacks by (i) maintaining a count of the number of rounds which have been successfully completed by each player, (ii) controlling the states of said player turn indicator to indicate each players turn, (iii) simulating ball bounce by establishing during each round a time period during which a player may effect simulated jacks pick-up by operation of said player switches, (iv) illuminating during each round a pseudo random sequence of selected ones of said display elements in said set, (v) extinguishing each illuminated display element responsive to operation of the player switch adjacent to that display element during said time period to simulate jack pick up, and (vi) changing the state of said player turn indicator responsive to continued illumination of any one of said selected display elements at the expiration of said time period to thereby end a player's turn when that player is unsuccessful in extinguishing all of the display elements that become illuminated during any round, whereby the winning player is the one to first successfully complete a predetermined number of rounds.

2. An electronic game as set forth in claim 1 in which said control means selects the number of display elements that are illuminated within said pseudo-random sequence during a given round as a function of the number of that round.

3. An electronic game as set forth in claim 1 in which said control means selects display elements that are illuminated during each round one at a time in sequence.

4. An electronic game as set forth in claim 1 in which a said control means retains said player turn indicator in one state between one round of play and the next seriation, until the player represented thereby either completes all of the predetermined number of rounds to win a game or is unsuccessful in completing a round, whichever comes first.

5. An electronic game as set forth in claim 1 in which said control means selects display elements for illumination during each round of a number greater than one.

6. An electronic game as set forth in claim 1 wherein said control means changes the state of said player turn indicator responsive to the completion of a round of play.

7. An electronic game as set forth in claim 1 wherein said control means includes means for communicating to a player at the beginning of a round the number of display elements that are to be illuminated during that round.

8. An electronic game as set forth in claim 1 wherein said time period established during a given round has a duration that is dependent upon the number of that round.

9. An electronic game as set forth in claim 1 further comprising:

Speaker means for producing sound; and wherein said control means energizes said speaker means during said time period of a player's turn.

10. An electronic game as set forth in claim 9 in which said audible sound comprises a tone and further comprising a frequency which changes monotonically between a first value and a second value and back again during each time period.

* * * * *